US008366537B2

(12) United States Patent
Lee

(10) Patent No.: US 8,366,537 B2
(45) Date of Patent: Feb. 5, 2013

(54) APPARATUS AND METHOD FOR CONTROLLING REEL GAME

(76) Inventor: Jae Hyung Lee, Daejeon (KR)

( * ) Notice: Subject to any disclaimer, the term of this patent is extended or adjusted under 35 U.S.C. 154(b) by 134 days.

(21) Appl. No.: 12/298,520

(22) PCT Filed: Jul. 21, 2008

(86) PCT No.: PCT/KR2008/004246

§ 371 (c)(1),
(2), (4) Date: May 28, 2010

(87) PCT Pub. No.: WO2010/005131

PCT Pub. Date: Jan. 14, 2010

(65) Prior Publication Data

US 2010/0234088 A1 Sep. 16, 2010

(30) Foreign Application Priority Data

Jul. 10, 2008 (KR) ..... 10-2008-0067011

(51) Int. Cl.
*A63F 9/24* (2006.01)

(52) U.S. Cl. ..... 463/20; 463/15; 463/16; 463/30

(58) Field of Classification Search ..... 463/15, 463/16, 20, 30

See application file for complete search history.

(56) References Cited

U.S. PATENT DOCUMENTS 7,473,173 B2 * 1/2009 Peterson et al. ..... 463/20
7,862,422 B2 * 1/2011 Garamendi et al. ..... 463/20
2001/0041611 A1 * 11/2001 Sakamoto ..... 463/20
2003/0199305 A1 10/2003 Mathis
2008/0026619 A1 1/2008 Chang
2008/0026818 A1 1/2008 Okada
2008/0026820 A1 1/2008 Okada (Continued)

FOREIGN PATENT DOCUMENTS

KR 1020070043190 A 4/2007
KR 10-2007-0055189 5/2007
KR 10-0760668 9/2007

OTHER PUBLICATIONS

PCT International Search Report for PCT Counterpart Application No. PCT/KR2008/004246 containing Communication relating to the Results of the Partial International Search Report, 2 pgs., (Apr. 10, 2009).

(Continued)

*Primary Examiner* — Pierre Eddy Elisca
*Assistant Examiner* — Shahid Kamal
(74) *Attorney, Agent, or Firm* — Blakely, Sokoloff, Taylor & Zafman LLP

(57) ABSTRACT

An apparatus and method for controlling reel games is described. The apparatus may include a display part for displaying an alignment status of reels caused by playing a first reel game. The apparatus may also include a control part for determining whether a combination of symbols or the number of event symbols of at least one or more reels sequentially re-aligned out of the reels satisfies a predetermined event-playing condition, and for playing the event. The apparatus may also include a user interface part for inputting user's random halt settings to spins of at least one or more remaining reels yet to be re-aligned out of the reels based on the playing of the event, and for stopping corresponding reel spins.

14 Claims, 6 Drawing Sheets

U.S. PATENT DOCUMENTS

| | | | | |
|---|---|---|---|---|
| 2008/0214283 | A1* | 9/2008 | Cregan et al. | 463/20 |
| 2009/0088239 | A1* | 4/2009 | Iddings et al. | 463/20 |
| 2009/0117973 | A1* | 5/2009 | Suda et al. | 463/20 |
| 2009/0131145 | A1* | 5/2009 | Aoki et al. | 463/20 |
| 2009/0227353 | A1* | 9/2009 | Yoshizawa | 463/20 |
| 2010/0234095 | A1* | 9/2010 | Cole et al. | 463/20 |
| 2011/0117987 | A1* | 5/2011 | Aoki et al. | 463/20 |
| 2011/0201404 | A1* | 8/2011 | Wells | 463/20 |

OTHER PUBLICATIONS

Office Action from Korean Patent Office for foreign counterpart Korean Patent Application No. 10-2008-0067011, 8 pgs., (Jan. 28, 2010).

* cited by examiner a)

b)

c)

d)

e)

f)

g)

APPARATUS AND METHOD FOR CONTROLLING REEL GAME

CROSS REFERENCE TO RELATED APPLICATION

This patent application is a U.S. National Phase application under 35 U.S.C. §371 of International Application No. PCT/KR2008/004246, filed on Jul. 21, 2008, entitled APPARATUS AND METHOD FOR CONTROLLING REEL GAME, which claims priority to South Korean application number 10-2008-0067011, filed Jul. 10, 2008.

TECHNICAL FIELD

The present invention relates to an apparatus and method for controlling reel games and, more particularly, to an apparatus and method for controlling reel games, which determines whether to play a predetermined event, such as an extra free bonus game, according to a combination of symbols or the number of specific symbols of reels variably displayed on a display area, and, by allowing a user to set user's random halts to reel spins for playing of the event on a reel-by-reel basis, provides a corresponding extra game depending on whether the bonus event is won.

BACKGROUND ART

In general, reel game machines such as slot machines or the like are classified into mechanical reel game machines which force annular reels each having plural symbols arranged in a series thereon to spin and stop through driving motors so as to directly display the annular reels in a display window, and electronic reel game machines which display reels of plural programmed symbols in a random manner on a display screen such as a monitor.

However, with such reel game machines, when a combination of reel symbols satisfies a winning condition, gamer can have fun in obtaining credits or winning points corresponding to the winning condition, but there exists a drawback since a gamer easily loses interest in such games due to the simple methods of such games.

In order to resolve such problem, the winning conditions are diversified by changing the number of reels and symbols, and so on, so that gamers can enjoy games without losing interest.

Efforts for changing such game methods of a reel game machine are exerted in various ways in such a fashion that gamers can enjoy games without losing interest, but there fails to appear any distinct game methods to such an extent as to be called a new method, except for already developed methods, and, in particular, the reality is that game methods are a very insufficient way to attract gamers to actively take part in games with interest.

A scheme to solve such problem is required.

TECHNICAL PROBLEM

Accordingly, the present invention has been created to solve the above problems, the object of which is to provide an apparatus and method for controlling reel games, which determines whether to play a predetermined bonus event, such as an extra free bonus game, according to a combination of symbols or the number of specific symbols of reels variably displayed on a display area, and, by allowing a user to set user's random halts to reel spins for playing of the bonus event on a reel-by-reel basis, provides a corresponding bonus game depending on whether the bonus event is won.

TECHNICAL SOLUTION

In order to achieve the above object, a reel game control apparatus according to the first aspect of the present invention includes a display part for displaying an alignment status of reels caused by playing a first reel game; a control part for determining whether a combination of symbols or the number of event symbols of at least one or more reels sequentially re-aligned out of the reels satisfies a predetermined event-playing condition, and for playing the event; and a user interface part for inputting user's random halt settings to spins of at least one or more remaining reels yet to be re-aligned out of the reels based on the playing of the event, and for stopping corresponding reel spins, wherein the control part provides a second reel game corresponding to the event depending on whether the combination of symbols or the number of event symbols of the reels appearing as a result of the playing of the event satisfies a predetermined event-winning condition.

Preferably, the reel game control apparatus further includes a payment settlement part for settling down a payment for reel games.

Preferably, the event-playing condition includes a condition in which the combination of symbols of at least one or more reels re-aligned matches a predetermined play combination rule or the number of event symbols is continuously or discontinuously counted to reach predetermined play symbol number.

Preferably, the control part reduces the spin velocity of the at least one or more remaining reels yet to be re-aligned if the event-winning condition is satisfied at a predetermined level.

Preferably, the control part allows a user to set the user's random halts to the spins of reels, and stops spins of corresponding reels through a predetermined reel-spin halt time period.

Preferably, the user interface part includes at least one or more of a button input module and a touch input module for inputting the user's random halt settings to the spins of reels.

Preferably, the event-winning condition includes a condition in which the combination of symbols of reels matches a predetermined play combination rule or the number of event symbols is continuously or discontinuously counted to reach a predetermined play symbol number.

Further, in order achieve the above object, a reel game control system according to the second aspect of the present invention includes at least one or more reel game control devices for playing an event depending on whether at least one or more reels re-aligned by playing a first reel game satisfy an event-playing condition, inputting user's random halt settings to spins of at least one or more remaining reels yet to be re-aligned by playing the event, and providing a second reel game corresponding to the event depending on whether a result formed by stopping spins of corresponding reels satisfies an event-winning condition; and an administrator server for changing and setting event parameters including the event-playing condition and the event-winning condition.

Preferably, the reel game control devices allow a user to set user's random halts to spins of reels, and stop spins corresponding reels through a predetermined reel-spin halt time period.

Preferably, the reel-spin halt time period is set through the administrator server by changing the event parameters.

Furthermore, in order to achieve the above object, a reel game control method according to the third aspect of the present invention includes a step, prior to playing of an event, for re-aligning reels aligned and displayed on a display area by playing a first reel game; an event-playing determination step for determining whether a combination of symbols or the number of event symbols of at least one or more reels sequentially re-aligned out of the reels satisfies predetermined event-playing condition; a user input step for, in case of playing an event, inputting user's random halt settings to spins of at last one or more remaining reels yet to be re-aligned out of the reels, and stopping spins corresponding reels; an event-winning determination step for determining whether the combination of symbols or the number of event symbols the reels formed by a result of the playing of an event satisfies a predetermined event-winning condition corresponding to the event-playing condition; and an event result play step for, in case of winning the event, providing a second reel game corresponding to the event.

Preferably, the reel game control method further includes a parameter-changing step for changing event parameters including the event-playing condition and the event-winning condition.

Preferably, the reel game control method further includes a first game-ending step for, in case the event is yet to be played, re-aligning at least one or more remaining reels yet to be re-aligned out of the reels, and ending the first reel game.

Preferably, the reel game control method further includes a second game-ending step for, in case the event fails to be won, ending the first reel game or playing a bonus game additionally coming with the first reel game.

Preferably, the user input step further includes an automatic reel-spin halt step for automatically stopping the spins of corresponding reels, in case any button input or touch input fails to be made to set the user's random halts to reel spins for a predetermined reel-spin halt time period.

ADVANTAGEOUS EFFECTS

Accordingly, the present invention determines whether to play a predetermined bonus event, such as an extra free bonus game, according to a combination of symbols or the number of specific symbols of reels variably displayed on a display area, and, by allowing a user to set user's random halts to reel spins for playing of the bonus event on a reel-by-reel basis, provides a corresponding bonus game depending on whether the bonus event is won, so there exists an advantage in that it is capable of directing gamers to actively participate in, so as not to lose interest in, games as well as easily realizing and providing various types of events to the gamers.

BEST MODE FOR THE INVENTION

Hereinafter, a reel game control system according to a preferred embodiment of the present invention will be described below in detail with reference to the accompany drawings.

Figure 1:
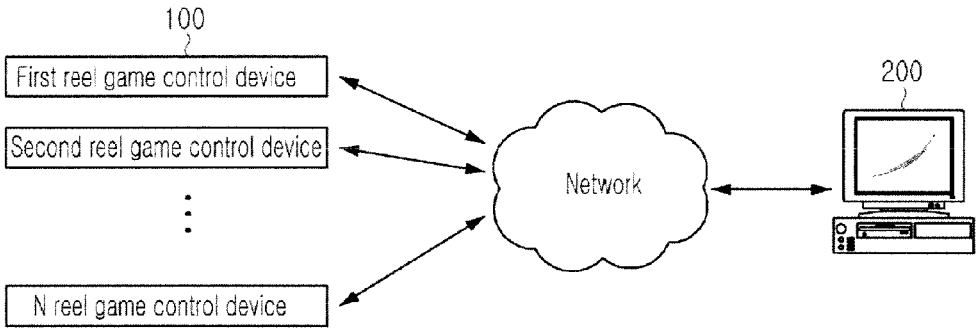
FIG. 1 is a view showing the structure of a reel game control system according to an embodiment of the present invention.

FIG. 1 is a view showing a reel game control system according to an embodiment of the present invention. As shown in FIG. 1 only for example purposes, the reel game control system includes at least one or more reel game control devices 100 for playing a corresponding event (for example, an event for providing an extra bonus game) depending on whether at least one or more reels re-aligned on the display screen by playing a first reel game (for example, a main game) satisfy an event-playing condition, allowing a user to stop on a reel-by-reel basis spins of at least one or more remaining reels yet to be re-aligned by the playing of the event, and providing a second reel game (for example, a bonus game) corresponding to an event depending on whether a result formed by ending the first reel game satisfies an event-winning condition; and an administrator server 200 (for example, it may be implemented into a personal computer) connected with the at least one or more reel game control devices 100 through a network, and for changing, setting, and managing various event parameters including event-playing conditions and event-winning conditions.

The reel game control devices 100 form event-playing conditions and event-winning conditions into sets, a number of sets being formed according to winning difficulties, and, by prompting a user to select any of such a number sets before playing a game, play an event based on the selected set.

Further, in case of playing an event based on satisfying a predetermined event-playing condition (for example, in case two event symbols appear on the screen), and, if a user fails to set halts to reel spins for a predetermined reel-spin halt time period (for example, 10 seconds), the reel game control devices 100 preferably stop the spins of corresponding reels automatically.

Such a reel-spin halt time period can be readily changed depending on the administration circumstances of an administrator by changing event parameters through the administrator server 200 or through manipulating the reel game control devices 100.

Figure 2:
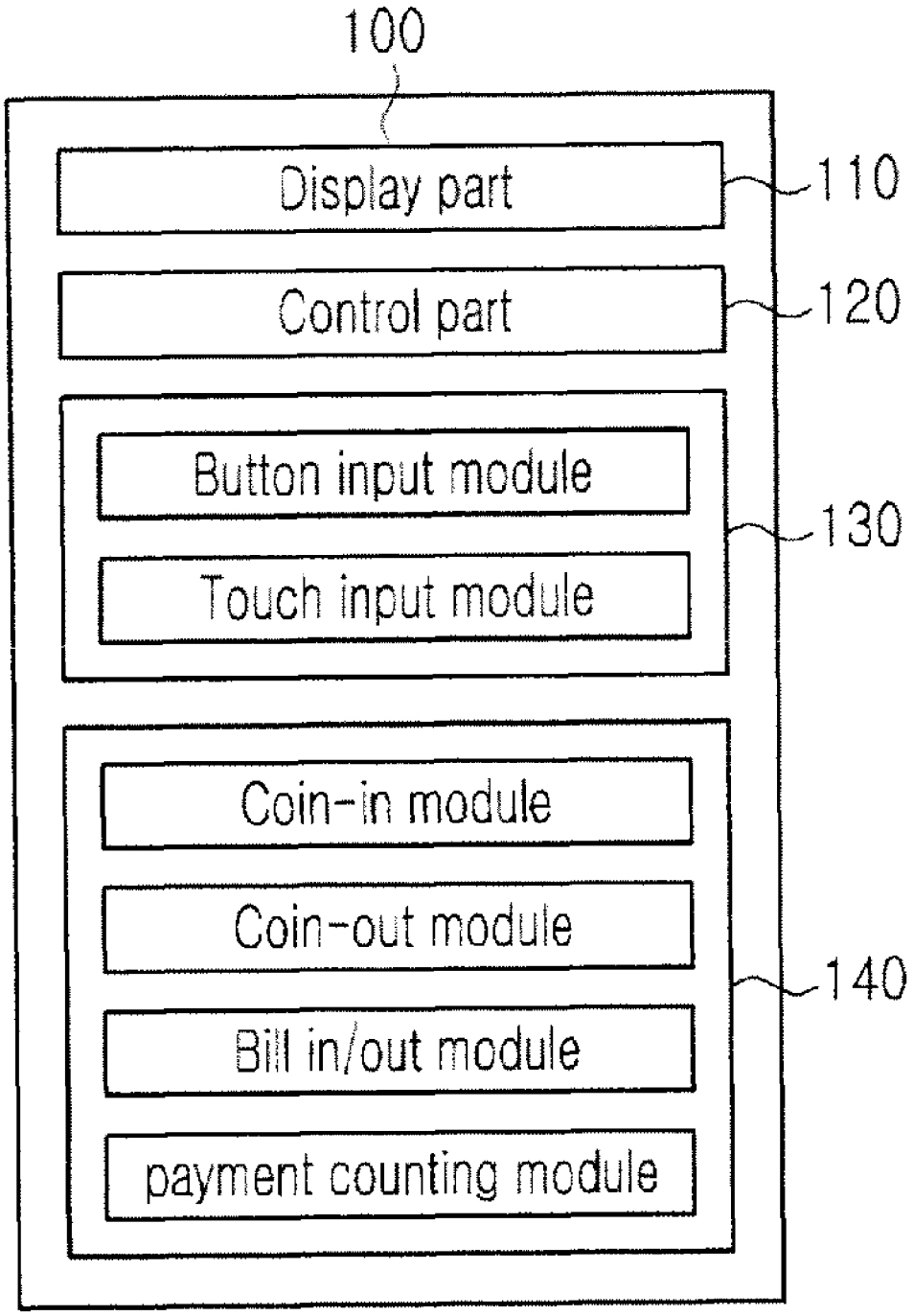
FIG. 2 is a view showing the structure of a reel game control device of FIG. 1.

FIG. 2 is a view showing a reel game control device 100 of FIG. 1. As shown in FIG. 2 only for example purposes, the reel game control device 100 includes a display part 110 for displaying an alignment status of reels appearing by playing a first reel game; a control part 120 for determining whether a combination of symbols or the number of event symbols of at least one or more reels sequentially re-aligned out of the displayed reels satisfies a predetermined event laying condition, and for playing a corresponding event; a user interface part 130 for allowing a user to user's random halts to spins of least one or more remaining reels be re-aligned out the reels by playing an event, and for halting the spins of corresponding reels; and a payment settlement processing part 140 for processing payment settlements for the first reel game.

Depending on whether a combination of symbols or the number of event symbols of the entire reels, which appears as an event-playing result upon completion of the first reel game, satisfies a predetermined event-winning condition, the control part 120 provides a second reel game corresponding to an event.

Further, provided with user's random halt settings to reel spins (for example, button inputs or touch inputs) on a reel-by-reel basis by playing an event, and, depending on to what extent of a predetermined level of an event-winning condition an event-playing result played reel by reel and accumulated step by step is satisfied, the control part 120 can be implemented to control (for example, reduce) the spin velocity over at least one or more remaining reels yet to be re-aligned.

Hereinafter, description will be made below in detail on an operation process of the reel game control device 100 with reference to the accompanying drawings.

Figure 3:
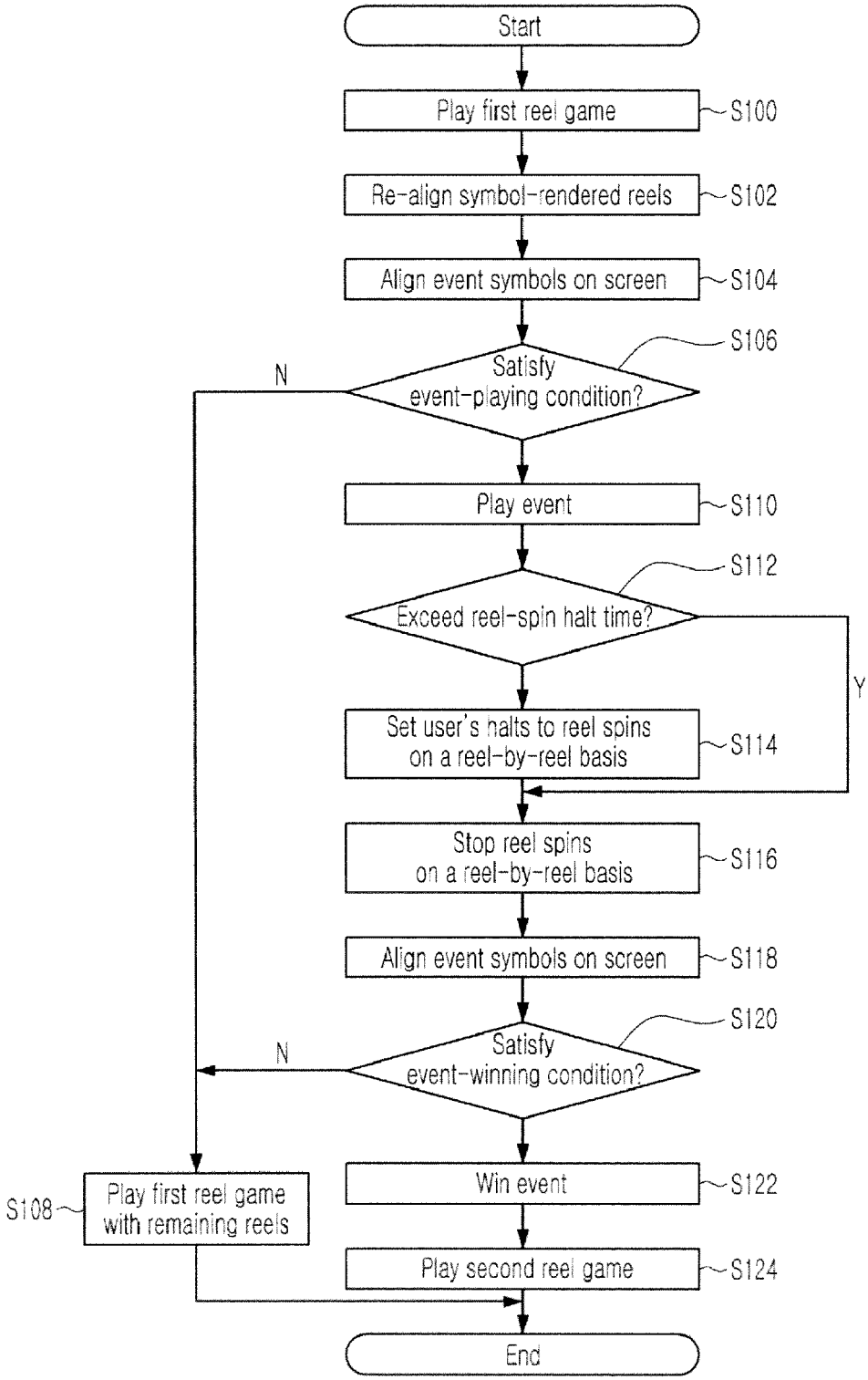
FIG. 3 is a flow chart showing an operation process of the reel game control device of FIG. 1 according to an embodiment of the present invention.

FIG. 3 is a flow chart for showing an operation process of the reel game control device 100 shown in FIG. 1 according to an embodiment of the present invention. As shown in FIG. 3 only for example purposes, a reel game control method proceeds with playing a first reel game (for example, a main game) and re-aligning on the display screen reels with various symbols rendered thereon (S100 and S102).

Thereafter, in case some of the entire reels are re-aligned and event symbols are aligned on the display screen (S104), it is determined whether the number of the aligned event symbols satisfies an event-playing condition (for example, it is set to play an event if the number of consecutive event symbols is two) (S106).

In the step S106, if unsatisfied for an event, games are played with remaining reels yet to be re-aligned in the first reel game (S108).

In the step S106, if satisfied for the event, the event is played to enable a user to set user's random halts to the spins of corresponding reels (S110), and, if a user sets halts to the spins of the corresponding reels within a predetermined reel-spin halt time period, the spins of the corresponding reels are halted (S112 and S116).

Further, it is determined whether additional event symbols from the spin-halted reels appear on the display screen, and it is checked if an event-winning condition is satisfied (S118 and S120).

Here, in case the first reel game is completed and satisfies an event-winning condition, there is provided an extra second reel game (for example, a bonus game) (S122 and S124).

Figure 4:
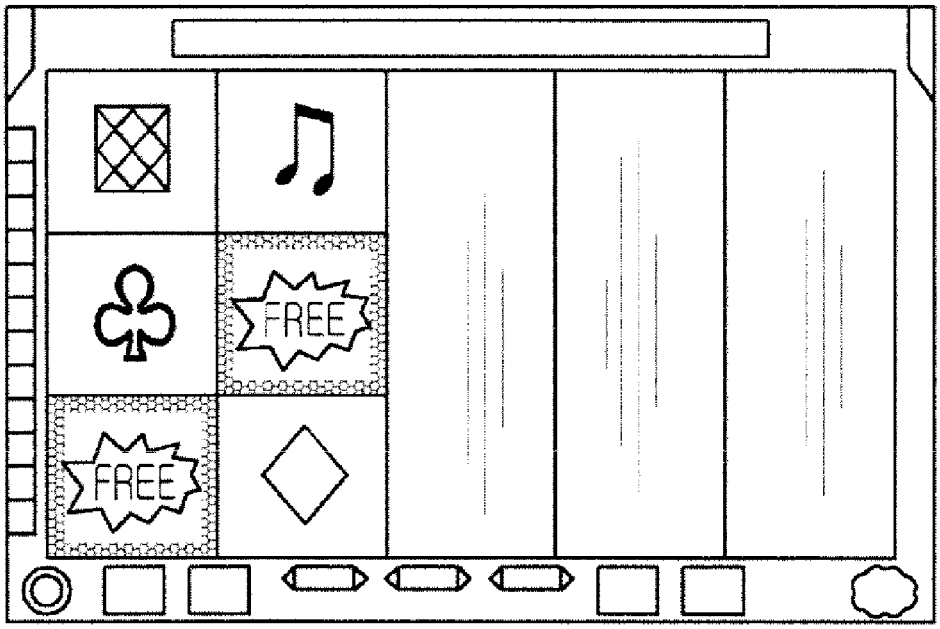
FIGS. 4 to 6 show exemplary displays on the display screen according to an operation process of the reel game control devices of FIG. 1.
Figure 4:
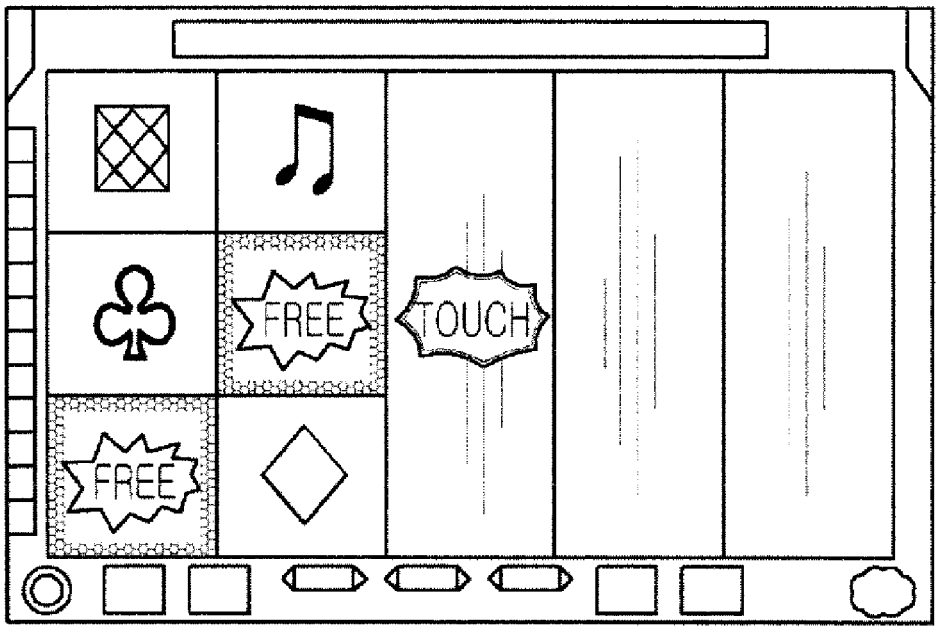
Figure 5:
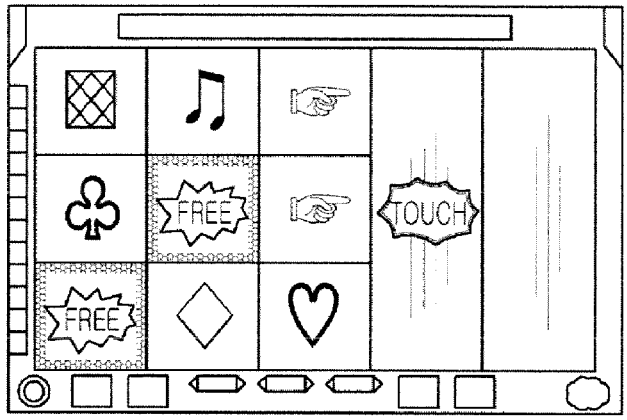
Figure 5:
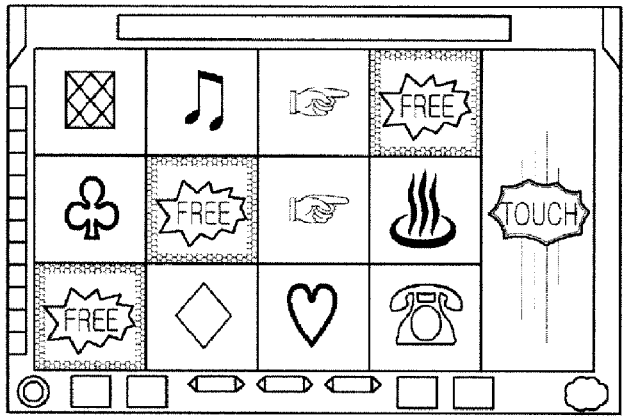
Figure 5:
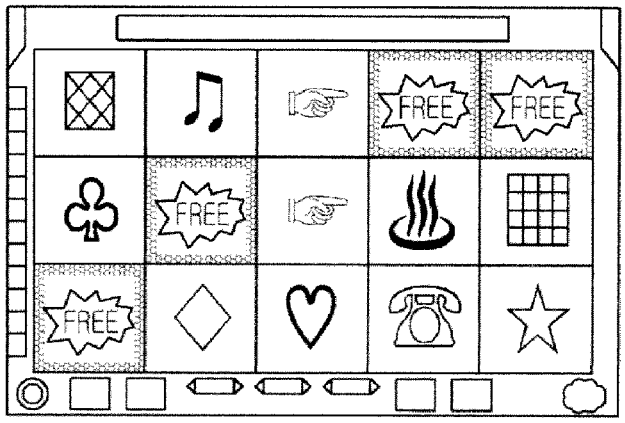
Figure 6:
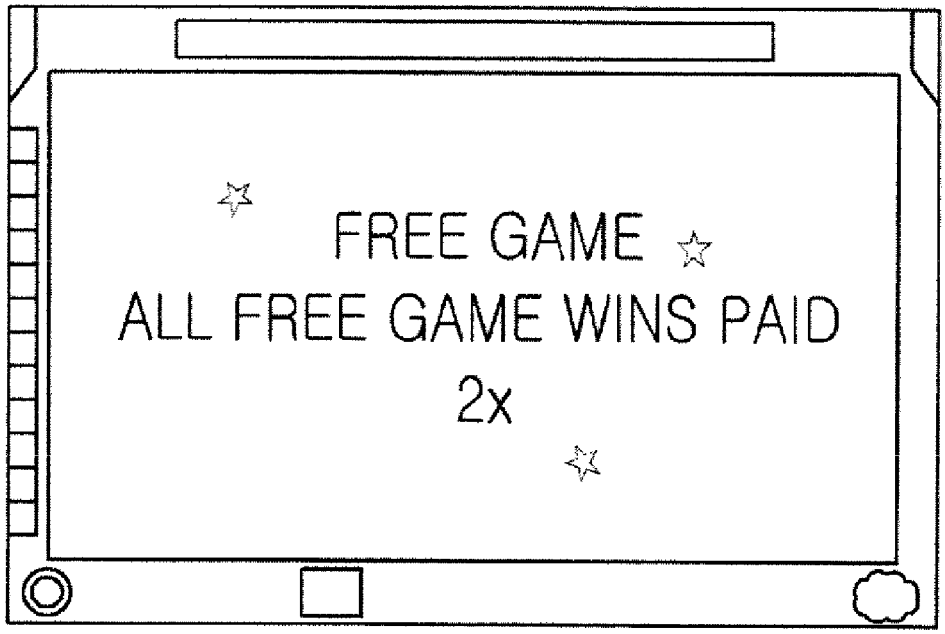
Figure 6:
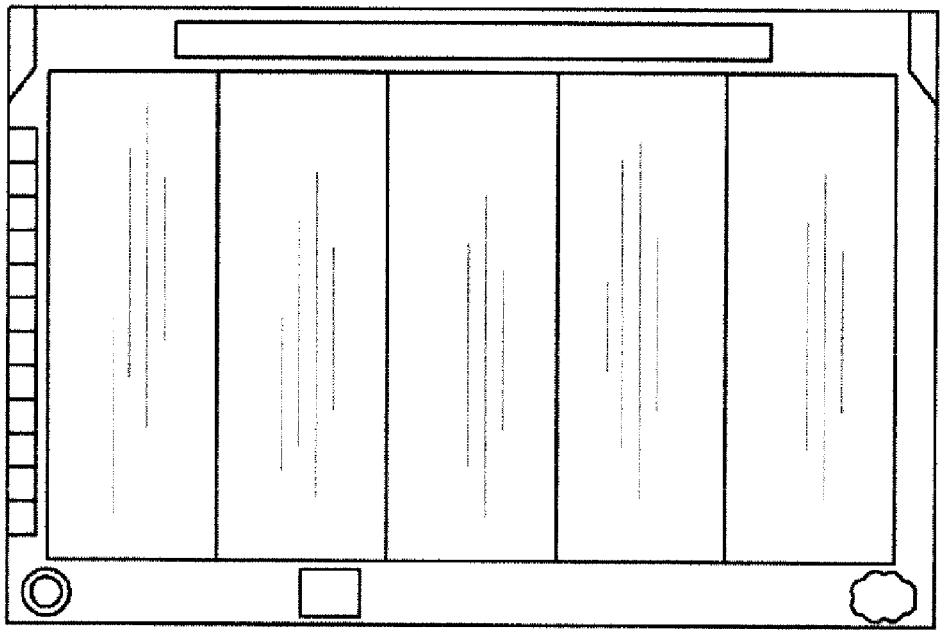

FIGS. 4 to 6 show exemplary displays on the display screen according to an operation process of the reel game control devices 100 of FIG. 1.

As shown in FIG. 4 only for example purposes, in a reel game control method, out of the whole five reels displayed on the display screen, a first reel game is played, and, since reel spins are halted on a reel-by-reel basis, after the first and second reel spins are halted and before the third reel spin is halted, the third to fifth reels are spinning (a of FIG. 4).

In a of FIG. 4, since two consecutive event symbols appear which satisfy an event-playing condition (that is, in case two event symbols in number appear consecutive), an event is played with the remaining reels, and a touch input icon appears on the third reel to prompt a user for a touch input (b of FIG. 4).

Thereafter, if the touch input is made by the user on the third reel or if a predetermined time period of 10 seconds lapses, the spin of the third reel is halted and it is determined whether an event symbol appears on the display screen, and the touch input icon appears on the fourth reel as well to ask a user for an additional touch input (c of FIG. 5).

Thereafter, if the touch input is made by the user on the fourth reel or if the predetermined time period of 10 seconds lapses, the spin of the fourth reel is halted and it is determined whether an additional event symbol appears on a display screen, and the touch input icon appears on the fifth reel to prompt a user for an additional touch input (d of FIG. 5).

If the spin of the fifth reel is halted, the game 'the first game' is completed, through the result of which it is determined whether an event is won. In case it is set for an event to be won if the number of event symbols is four, there can be provided an additional second game (e of FIG. 5F). Here, since an event-won result appears on the display screen, a user is informed that he is going into a second game (f of FIG. 6).

Thereafter, the display screen is converted for playing of the second game provided additionally (g of FIG. 6).

While the preferred embodiment has been described above, it should be understood that those skilled in the art can make various changes and modifications without departing from the scope and spirit of the present invention as claimed in the appended claims.

INDUSTRIAL APPLICABILITY

Further, the present invention determines whether to play a predetermined event (for example, providing an extra bonus game) depending on a combination of symbols or the number of specific symbols of reels variably displayed on the display area, and, by allowing a user to set user's random halts to reel spins on a reel-by-reel basis for playing of the event, provides a corresponding extra game according whether the event is won. Therefore, the present invention has enough feasibility for sales on the market or marketing as well as industrial applicability since it can be expressly implemented in reality.

What is claimed is:

1. A reel game control apparatus, comprising:

a display part for displaying an alignment status of reels caused by playing a first reel game;

a control part for determining whether a combination of symbols or the number of event symbols of at least one or more reels, which are a subset of the reels, sequentially and automatically re-aligned out of the reels satisfies a predetermined event-playing condition, and for playing the event; and a user interface part for inputting user's random halt settings to spins of at least one or more remaining reels, which are not part of the subset of reels, yet to be re-aligned out of the reels based on the playing of the event, and for stopping reel spins on a reel-by-reel basis in response to receipt of the user's random halt settings, wherein the control part provides a second reel game corresponding to the event depending on whether the combination of symbols or the number of event symbols of the reels appearing as a result of the playing of the event satisfies a predetermined event-winning condition, wherein based on an extent that a predetermined level of the event-winning condition played on the reel-by-reel basis is satisfied and accumulated, the control part reduces a spin velocity of the at least one or more remaining reels yet to be re-aligned.

2. The apparatus claimed in claim 1, further comprising a payment settlement part for settling down a payment for reel games.

3. The apparatus claimed in claim 1, wherein the event-playing condition includes a condition in which the combination of symbols of at least one or more reels re-aligned matches a predetermined play combination rule or the number of event symbols is continuously or discontinuously counted to reach a predetermined play symbol number.

4. The apparatus claimed in claim 1, wherein the control part allows a user to set the user's random halts to the spins of reels, and stops spins of corresponding reels through a predetermined reel-spin halt time period.

5. The apparatus claimed in claim 1, wherein the user interface part includes at least one or more of a button input module and a touch input module for inputting the user's random halt settings to the spins of reels.

6. The apparatus claimed in claim 1, wherein the event-winning condition includes a condition in which the combination of symbols of reels matches a predetermined play combination rule or the number of event symbols is continuously or discontinuously counted to reach a predetermined play symbol number.

7. A reel game control system, comprising:

at least one or more reel game control devices for playing an event depending on whether at least one or more reels, which are a subset of the reels, re-aligned automatically by playing a first reel game satisfy an event-playing condition, inputting user's random halt settings to spins of at least one or more remaining reels, which are not part of the subset of reels, yet to be re-aligned by playing the event, and providing a second reel game corresponding to the event depending on whether a result formed by stopping spins of corresponding reels satisfies an event-winning condition, wherein based on an extent that a predetermined level of the event-winning condition is satisfied and accumulated, a spin velocity of the at least one or more remaining reels yet to be re-aligned is reduced; and an administrator server for changing and setting event parameters including the event-playing condition and the event-winning condition.

8. The system claimed in claim 7, wherein the reel game control devices allow a user to set user's random halts to spins of reels, and stop spins of corresponding reels through a predetermined reel-spin halt time period.

9. The system claimed in claim 8, wherein the reel-spin halt time period is set by changing the event parameters through the administrator server.

10. A reel game control method, comprising:

an operation, prior to playing of an event, for re-aligning, with a reel game control device, reels aligned and displayed on a display area by playing a first reel game;

an event-playing determination operation for determining, with the reel game control device, whether a combination of symbols or the number of event symbols of at least one or more reels, which are a subset of the reels, sequentially and automatically re-aligned out of the reels satisfies a predetermined event-playing condition;

a user input operation for, in case of playing an event, inputting, with the reel game control device, user's random halt settings to spins of at least one or more remaining reels, which are not part of the subset of reels, yet to be re-aligned out of the reels, and stopping spins of corresponding reels;

an event-winning determination operation for determining, with the reel game control device, whether the combination of symbols or the number of event symbols of the reels formed by a result of the playing of an event satisfies a predetermined event-winning condition corresponding to the event-playing condition, wherein based on an extent that a predetermined level of the event-winning condition is satisfied and accumulated, a spin velocity of the at least one or more remaining reels yet to be re-aligned is reduced; and an event result play operation for, in case of winning the event, providing, with the reel game control device, a second reel game corresponding to the event.

11. The method claimed in claim 10, further comprising a parameter-changing operation for changing event parameters including the event-playing condition and the event-winning condition.

12. The method claimed in claim 10, further comprising a first game-ending operation for, in case the event is yet to be played, re-aligning at least one or more remaining reels yet to be re-aligned out of the reels, and ending the first reel game.

13. The method claimed in claim 10, further comprising a second game-ending operation for, in case the event fails to be won, ending the first reel game or playing a bonus game additionally coming with the first reel game.

14. The method claimed in claim 10, wherein the user input operation further includes an automatic reel-spin halt operation for automatically stopping the spins of corresponding reels, in case any button input or touch input fails to be made to set the user's random halts to reel spins for a predetermined reel-spin halt time period.

* * * * *